US006868554B1

(12) United States Patent
Melvin

(10) Patent No.: US 6,868,554 B1
(45) Date of Patent: Mar. 22, 2005

(54) HAIR SALON ACCESSORY GARMENT

(76) Inventor: Mary L. Melvin, P.O. Box 121021, Fort Lauderdale, FL (US) 33312

( * ) Notice: Subject to any disclaimer, the term of this patent is extended or adjusted under 35 U.S.C. 154(b) by 0 days.

(21) Appl. No.: 10/857,065

(22) Filed: Jun. 1, 2004

(51) Int. Cl.[7] ..... A41D 13/04
(52) U.S. Cl. ..... 2/50; 2/49.4
(58) Field of Search ..... 2/50, 49.1–49.5, 2/51, 52, 46, 48, 468, 85, 87, 88, 93, 97, 102, 103, 105, 106, 108, 115, 116

(56) References Cited

U.S. PATENT DOCUMENTS

| | | | | | |
|---|---|---|---|---|---|
| 45,595 | A | | 12/1864 | Flautt | |
| 363,790 | A | * | 5/1887 | Alley | 2/51 |
| 1,094,345 | A | * | 4/1914 | Robertson | 2/50 |
| 1,216,088 | A | * | 2/1917 | De Vingo | 2/50 |
| 1,251,127 | A | * | 12/1917 | Squier | 2/50 |
| 1,391,121 | A | * | 9/1921 | Keppel | 2/49.5 |
| 1,660,124 | A | * | 2/1928 | Grom | 2/50 |
| 1,979,879 | A | * | 11/1934 | Harris | 2/48 |
| 2,093,483 | A | * | 9/1937 | Sackett | 2/50 |
| 2,110,544 | A | * | 3/1938 | Dauphin | 2/50 |
| 2,116,685 | A | * | 5/1938 | Nicolet | 2/50 |
| 2,289,526 | A | * | 7/1942 | Tapper | 2/50 |
| 2,947,004 | A | * | 8/1960 | Pfile | 2/50 |
| 3,514,788 | A | * | 6/1970 | Miller | 2/87 |
| 3,857,116 | A | * | 12/1974 | Meeker | 2/50 |
| 4,458,364 | A | | 7/1984 | Fenninger et al. | |
| 4,710,980 | A | | 12/1987 | Brison et al. | |
| 5,079,777 | A | | 1/1992 | Fowler et al. | |
| 5,572,740 | A | | 11/1996 | Geniesse | |
| 5,950,236 | A | * | 9/1999 | Andrew et al. | 2/50 |
| 5,953,753 | A | * | 9/1999 | Perez | 2/50 |
| 6,216,281 | B1 | | 4/2001 | Fricke | |
| 2004/0139533 | A1 | * | 7/2004 | Kurpis | 2/468 |

* cited by examiner

*Primary Examiner*—Amy B. Vanatta

(57) ABSTRACT

A clothing accessory for directing hair and water downwardly and away from a user's neck includes an inner layer provided with an annular neck portion that is removably positionable about a user's neck. The accessory further includes an outer layer that is non-integral with the inner layer, has a body provided with a collar portion positionable over and about a neck portion of the inner layer, wherein the neck portion extends upwardly and over the collar portion for advantageously assisting to absorb fluids traveling downwardly towards the collar portion. The outer layer further has a groove formed therein and extending along a bottom portion thereof for channeling fluids outwardly and away from a user's garment during operating conditions.

18 Claims, 3 Drawing Sheets

HAIR SALON ACCESSORY GARMENT

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a hair salon accessory and, more particularly, to a hair salon accessory garment for directing hair and water downwardly and away from a user's neck.

2. Prior Art

At present, to protect the clothing of customers during haircutting, there is generally used in hairdressing salons bibs with or without sleeves closed at the back of the customer and towels for drying the hair after shampooing and for protection of the bib and clothing against the products that are used. These known towels and bibs provide fairly good protection, but the towels can ordinarily be used only one time because of hygienic reasons and must then be washed, and do not permit complete deflection of the cut hairs, which can cause a customer great discomfort.

During the processing of hair, which includes washing, coloring, and perming, beauticians routinely use towels tucked into the neckline of the customer's clothing to absorb excess liquid dripping down the customer's neck. Sometimes the liquid penetrates the towel to wet and stain the clothing and/or irritate the customer's skin. Most beauticians recommend that their customers who are having their hair permed or colored either wear old clothes or change into a smock to prevent clothing damage from the chemicals used in hair coloring and perming.

The smocks are made from a variety of materials, such as fine denier fabrics woven from nylon or cotton/polyester blends, which absorb liquid to a certain extent. Many customers, however, prefer not to change into smocks since they are not always washed after every use. It is also inconvenient to have to carry along a change of clothing to the beauty parlor.

Accordingly, a need remains for a hair salon accessory garment that overcomes the above-noted shortcomings.

BRIEF SUMMARY OF THE INVENTION

In view of the foregoing background, it is therefore an object of the present invention to provide a hair salon accessory garment. These and other objects, features, and advantages of the invention are provided by a clothing accessory for directing hair and water downwardly and away from a user's neck.

The clothing accessory includes an inner layer formed from fluid-absorbent material that has a flexible body provided with an annular neck portion integral therewith. The annular neck portion is removably positionable about a user's neck wherein the body travels downwardly therefrom for conveniently covering a select portion of the user's torso.

The inner layer includes a mechanism for fastening the neck portion subjacent to a user's hair line so that foreign debris can be effectively discharged away from the user's neck and, advantageously preventing foreign debris from causing user discomfort. The fastening mechanism is disposed adjacent to the neck portion and may include a plurality of buttons, for example, spaced about the neck portion. Of course, various fastening mechanisms may be employed by the present invention such as Velcro, for example, without departing from the true scope of the invention.

The present invention further includes an outer layer formed from fluid-impermeable material, preferably nylon, that is non-integral with the inner layer. Such an outer layer has a body provided with a collar portion, preferably having a U-shape, positionable over and about the neck portion of the inner layer. Advantageously, the outer surface preferably has a generally arcuate lower edge portion and is provided with a groove that extends adjacent thereto along a substantially symmetric path.

The outer layer body preferably has a surface area greater than the surface area of the inner layer, and extends beyond the select torso portion. The outer layer further includes a mechanism for fastening the outer layer body over the inner layer body wherein the neck portion extends upwardly and over the collar portion for advantageously absorbing fluids and foreign debris traveling downwardly towards the collar portion. Of course, similar to the inner layer fastening mechanism, the outer layer fastening mechanism may also include a plurality of buttons, or like members, spaced about the collar portion.

The outer layer preferably has a centrally disposed longitudinal axis and a top surface oppositely spaced from the inner layer. The groove is preferably formed within the top surface and is isolated from the inner layer while extending along a width thereof for advantageously receiving and directing fluids laterally from the axis during operating conditions.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
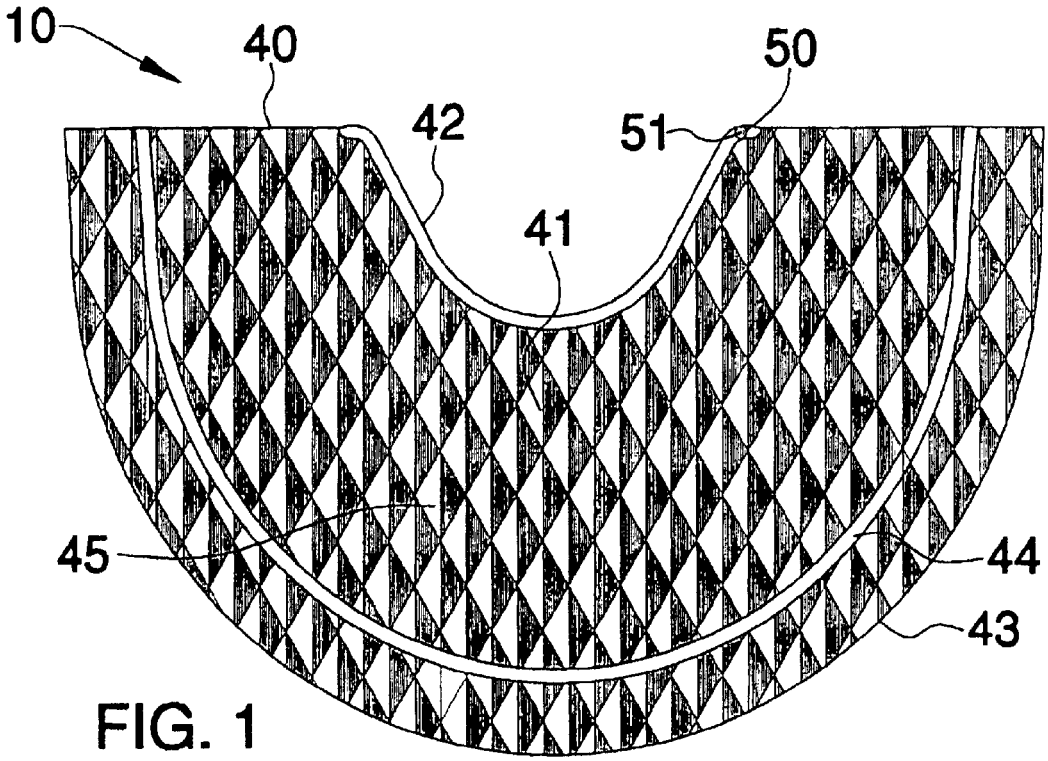
FIG. 1 is a front elevational view showing the outer layer of a hair salon accessory garment apparatus, in accordance with the present invention.
Figure 2:
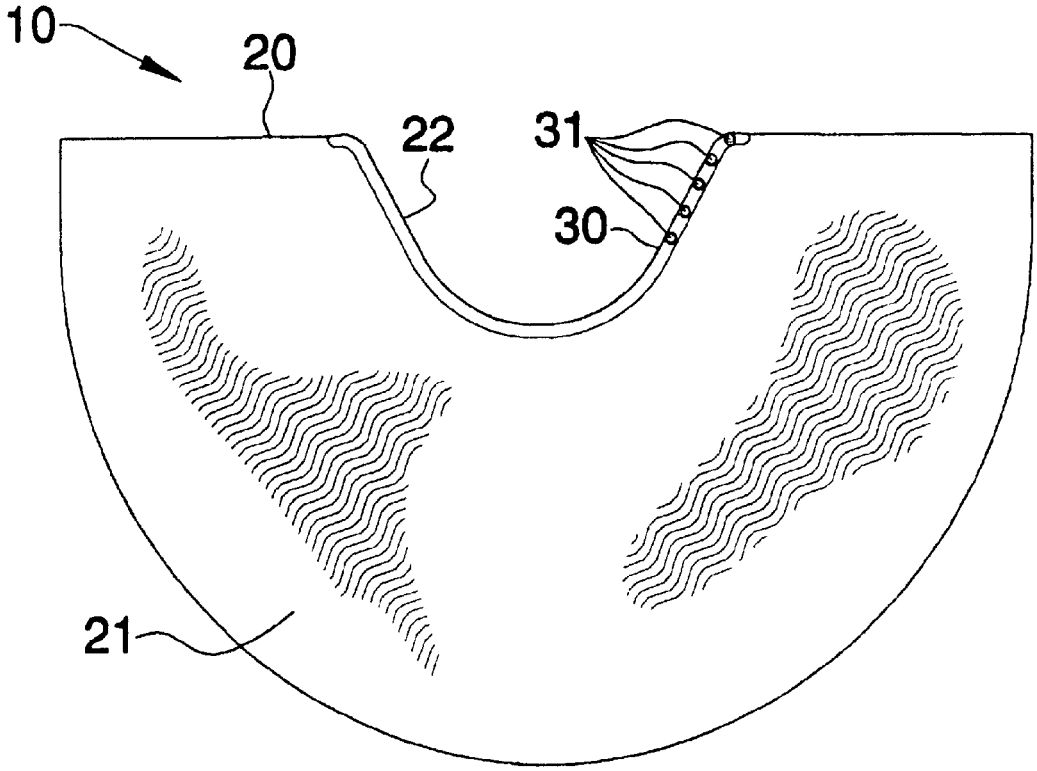
FIG. 2 is a front elevational view showing the inner layer of the salon accessory garment, in accordance with the present invention.
Figure 3:
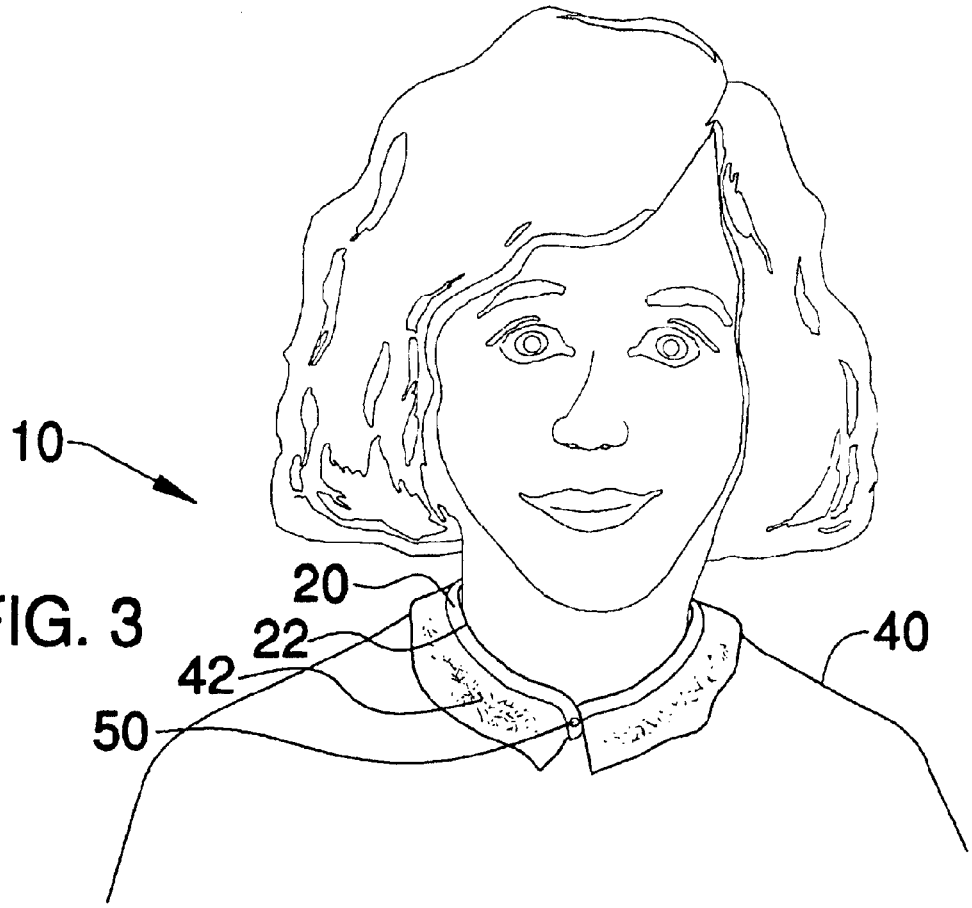
FIG. 3 is a front elevational view showing the neck portion of the inner layer exposed about the collar portion of the outer layer, when worn by a user.
Figure 4:
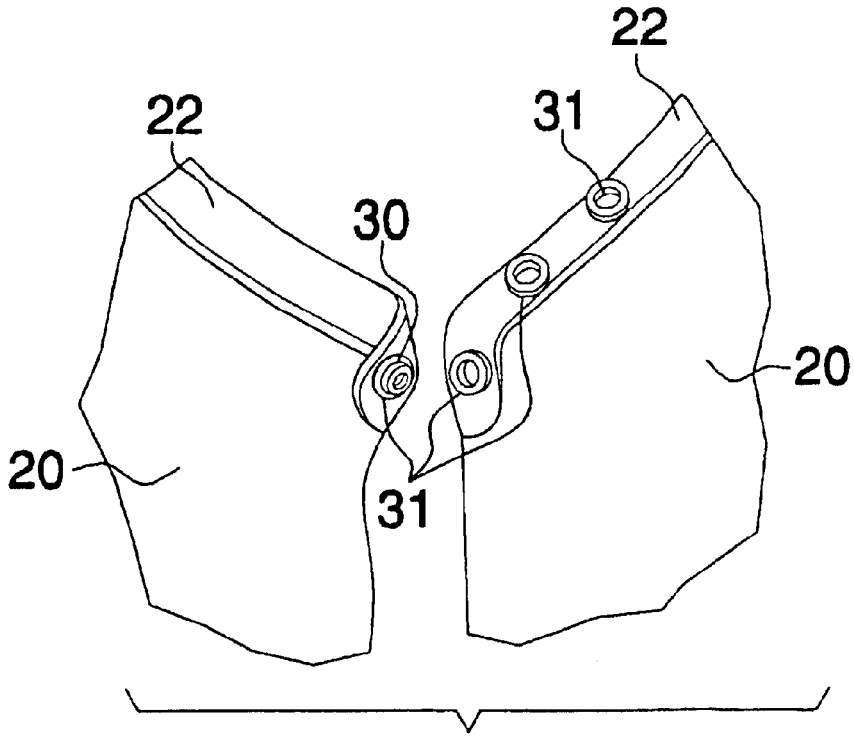
FIG. 4 is a partial perspective view showing the fastening mechanism of the inner layer.
Figure 5:
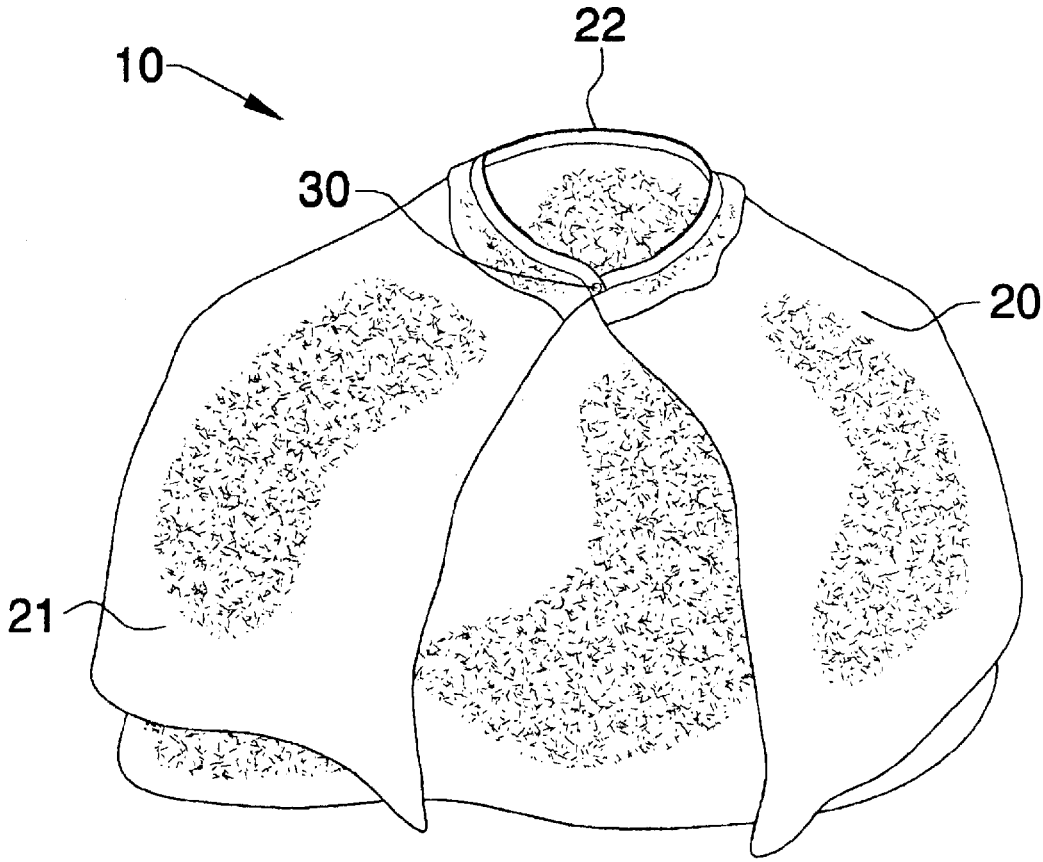
FIG. 5 is a perspective view showing the flexible body of the inner layer.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–5 by the reference numeral 10 and is intended to provide a hair salon accessory garment. It should be understood that the apparatus 10 may be used for many different types of hair salon procedures and should not be construed as being limited to only conventional hair cutting procedures.

Referring initially to FIG. 1, the apparatus 10 includes an inner layer 20 formed from fluid-absorbent material that has a flexible body 21 provided with an annular neck portion 22 integral therewith. The absorbent material advantageously absorbs any water that might run down the user's neck, as often happens during shampooing or hair cutting procedures. The annular neck portion 22 is removably positionable about a user's neck wherein the body 21 travels downwardly therefrom for conveniently covering a select portion of the user's torso.

The inner layer 20 includes a mechanism 30 for fastening the neck portion 22 subjacent to a user's hair line so that foreign debris (not shown) can be effectively discharged away from the user's neck and, advantageously preventing foreign debris (not shown) from causing user discomfort. The fastening mechanism 30 is disposed adjacent to the neck portion 22 and includes a plurality of buttons 31, for example, spaced about the neck portion 22. Of course, various fastening mechanisms 30 may be employed by the present invention such as Velcro (not shown), for example, without departing from the true scope of the invention. Both types of fastening mechanisms 30 advantageously allow a user to selectively adjust the diameter of the neck portion 22 so that on size can be used on persons with small or large necks, respectively.

The present invention further includes an outer layer 40 formed from fluid-impermeable material, preferably nylon, that is non-integral with the inner layer 20. Such an outer layer 40 has a body 41 provided with a collar portion 42, having a U-shape, positionable over and about the neck portion 22 of the inner layer 20. Advantageously, the outer surface 45 has a generally arcuate lower edge portion 43 and is provided with a groove 44 that extends adjacent thereto along a substantially symmetric path.

The outer layer 40 body 41 has a surface area greater than the surface area of the inner layer 20, and extends beyond the select torso portion. The extended outer layer 40 further protects a user's skin and clothing from being soaked with undesirable fluids or debris. The outer layer 40 further includes a mechanism 50 for fastening the outer layer 40 body 41 over the inner layer 20 body 21 wherein the neck portion 22 extends upwardly and over the collar portion 42 for advantageously absorbing fluids and foreign debris (not shown) traveling downwardly towards the collar portion 42. This also helps maintain the inner layer 20 at a substantially stable position during operating conditions for improving user comfort. Of course, similar to the inner layer 20 fastening mechanism 30, the outer layer 40 fastening mechanism 50 also includes a plurality of buttons 51, or like members, spaced about the collar portion 42, thus allowing it to be selectively sized and positioned.

The outer layer 40 has a centrally disposed longitudinal axis and a top surface 45 oppositely spaced from the inner layer. The groove 44 is formed within the top surface 45 and is isolated from the inner layer 20 while extending along a width thereof for advantageously receiving and directing fluids laterally from the axis during operating conditions.

Hair dressers employing the apparatus 10 will appreciate its durability, versatility, practicality, and effectiveness. With the apparatus 10, clients have a peace of mind knowing that their clothes will be kept dry and clean while during various salon procedures. The apparatus 10 also effectively prevents clothing stains in the event of a hair coloring procedure. The apparatus 10 will not only be appreciated by clients, but also by hairdressers of all skill levels.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A clothing accessory for directing hair and water downwardly and away from a user's neck, said clothing accessory comprising:

an inner layer formed from fluid-absorbent material and having a flexible body provided with an annular neck portion integral therewith, said annular neck portion being removably positionable about a user's neck wherein said body travels downwardly therefrom for covering a select portion of the user's torso, said inner layer comprising means for fastening said neck portion subjacent a users hair line so that foreign debris can be effectively discharged away therefrom, said fastening means being disposed adjacent said neck portion; and an outer layer formed from fluid-impermeable material and being non-integral with said inner layer, said outer layer having a body provided with a collar portion positionable over and about said neck portion, said outer layer body having a surface area greater than a surface area of said inner layer and extending beyond the select torso portion, said outer layer comprising means for fastening said outer layer body over said inner layer body wherein said neck portion extends upwardly and over said collar portion for assisting to absorb fluids traveling downwardly towards said collar portion.

2. The clothing accessory of claim 1, wherein said outer layer further has a centrally disposed longitudinal axis and a top surface oppositely spaced from said inner layer, said top surface having a groove formed therein and extending along a width thereof for receiving and directing fluids laterally from the axis during operating conditions.

3. The clothing accessory of claim 1, wherein said collar portion has a U-shape.

4. The clothing accessory of claim 2, wherein said top surface has a generally arcuate lower edge portion and the groove is substantially equally spaced therefrom.

5. The clothing accessory of claim 1, wherein said inner layer fastening means comprises: a plurality of buttons spaced about said neck portion.

6. The clothing accessory of claim 1, wherein said outer layer fastening means comprises: a plurality of buttons spaced about said collar portion.

7. The clothing accessory of claim 1, wherein said outer layer is formed from nylon.

8. A clothing accessory for directing hair and water downwardly and away from a user's neck, said clothing accessory comprising:

an inner layer formed from fluid-absorbent material and having a flexible body provided with an annular neck portion integral therewith, said annular neck portion being removably positionable about a user's neck wherein said body travels downwardly therefrom for covering a select portion of the user's torso, said inner layer comprising means for fastening said neck portion subjacent a user's hair line so that foreign debris can be effectively discharged away therefrom, said fastening means being disposed adjacent said neck portion; and an outer layer formed from fluid-impermeable material and being non-integral with said inner layer, said outer layer having a body provided with a collar portion positionable over and about said neck portion, said outer layer body having a surface area greater than a surface area of said inner layer and extending beyond the select torso portion, said outer layer comprising means for fastening said outer layer body over said inner layer body wherein said neck portion extends upwardly and over said collar portion for assisting to absorb fluids traveling downwardly towards said collar portion, said outer layer further having a centrally disposed longitudinal axis and a top surface oppositely spaced from said inner layer, said top surface having a groove formed therein and extending along a width thereof for receiving and directing fluids laterally from the axis during operating conditions.

9. The clothing accessory of claim 8, wherein said collar portion has a U-shape.

10. The clothing accessory of claim 8, wherein said top surface has a generally arcuate lower edge portion and the groove is substantially equally spaced therefrom.

11. The clothing accessory of claim 8, wherein said inner layer fastening means comprises: a plurality of buttons spaced about said neck portion.

12. The clothing accessory of claim 8, wherein said outer layer fastening means comprises: a plurality of buttons spaced about said collar portion.

13. The clothing accessory of claim 8, wherein said outer layer is formed from nylon.

14. A clothing accessory for directing hair and water downwardly and away from a user's neck, said clothing accessory comprising:

an inner layer formed from fluid-absorbent material and having a flexible body provided with an annular neck portion integral therewith, said annular neck portion being removably positionable about a user's neck wherein said body travels downwardly therefrom for covering a select portion of the users torso, said inner layer comprising means for fastening said neck portion subjacent a user's hair line so that foreign debris can be effectively discharged away therefrom, said fastening means being disposed adjacent said neck portion; and an outer layer formed from fluid-impermeable material and being non-integral with said inner layer, said outer layer having a body provided with a U-shaped collar portion positionable over and about said neck portion, said outer layer body having a surface area greater than a surface area of said inner layer and extending beyond the select torso portion, said outer layer comprising means for fastening said outer layer body over said inner layer body wherein said neck portion extends upwardly and over said collar portion for assisting to absorb fluids traveling downwardly towards said collar portion, said outer layer further having a centrally disposed longitudinal axis and a top surface oppositely spaced from said inner layer, said top surface having a groove formed therein and extending along a width thereof for receiving and directing fluids laterally from the axis during operating conditions.

15. The clothing accessory of claim 14, wherein said top surface has a generally arcuate lower edge portion and the groove is substantially equally spaced therefrom.

16. The clothing accessory of claim 14, wherein said inner layer fastening means comprises: a plurality of buttons spaced about said neck portion.

17. The clothing accessory of claim 14, wherein said outer layer fastening means comprises: a plurality of buttons spaced about said collar portion.

18. The clothing accessory of claim 14, wherein said outer layer is formed from nylon.

* * * * *